United States Patent [19]

Kageyama et al.

[11] 4,371,277

[45] Feb. 1, 1983

[54] AUTOMATIC PENCIL

[75] Inventors: Hidehei Kageyama; Takahiko Suzuki, both of Kawagoe, Japan

[73] Assignee: Kotobuki & Co., Ltd., Saitama, Japan

[21] Appl. No.: 269,760

[22] Filed: Jun. 2, 1981

[30] Foreign Application Priority Data

Jul. 25, 1980 [JP] Japan ..... 55-105958[U]
Mar. 19, 1981 [JP] Japan ..... 56-38405[U]
Mar. 19, 1981 [JP] Japan ..... 56-38408[U]

[51] Int. Cl.[3] ..... B53K 21/02
[52] U.S. Cl. ..... 401/54; 401/65
[58] Field of Search ..... 401/54, 53, 81, 65

[56] References Cited

U.S. PATENT DOCUMENTS 1,769,572 7/1930 Grosz ..... 401/54
1,780,405 11/1930 Sharrow ..... 401/54
2,604,070 7/1952 Sharrow ..... 401/54
3,864,046 2/1975 Butka ..... 401/53

*Primary Examiner*—Stephen C. Pellegrino
*Attorney, Agent, or Firm*—Bernard, Rothwell & Brown

[57] ABSTRACT

An automatic pencil which comprises a pointed end cap made of a synthetic resin material into which a lead pushing-out mechanism consisting of a lead chuck fixed to a lead container, a chuck ring externally fitted onto the lead chuck and a spring is inserted, a cushion stopper on the outer periphery of which and at one end thereof engaging projections are integrally formed so as to oppose to a plurality of engaging holes circumferentially provided around an open edge of the pointed end cap, and an outer tube into which the outer periphery of the backward end of the aforesaid pointed end cap is inserted to combine them with each other and, as a consequence, the resultant automatic pencil has a simple construction, so that it can easily be assembled.

7 Claims, 52 Drawing Figures

32
40
B
B 32
40

41
33
41
33

33

32
40

32
40

33

32
40
40a 32
40

41
33
41
33

33

AUTOMATIC PENCIL

BACKGROUND OF THE INVENTION

1. Field of the Invention

The present invention relates to an automatic pencil, and more particularly, to an automatic pencil in which a lead pushing-out mechanism is internally mounted in a guide means.

2. Description of the Prior Art

In a conventional automatic pencil, a lead pushing-out mechanism has been mounted through a connecting member disposed between a guide means and outer tube. As a consequence, it is necessary to assemble the guide means, outer tube and connecting member parts after these parts have been once separately disassembled in view of the assembly construction. And it results in increase of man-hour for the assembly and complicatedness of parts to be worked, so that it has been difficult to manufacture such automatic pencil at a low cost.

Furthermore, in case of such an automatic pencil to which a means for preventing breakup of lead by which the lead is retracted when an excessive writing pressure is particularly applied to the automatic pencil is added, since a spring for adjusting writing pressure is installed in the automatic pencil other than a so-called knocking spring, it produces such disadvantage that the assembling operations become more difficult.

SUMMARY OF THE INVENTION

It is a principal object of the present invention to provide an automatic pencil by which various disadvantages as mentioned above of conventional automatic pencils can be eliminated.

Another object of the invention is to provide an automatic pencil with a simple construction and easy assembling having a novel guide means mechanism.

A further object of the invention is to provide an automatic pencil by which the adjustment of writing pressure may be varied.

A still further object of the invention is to provide an automatic pencil in which a stopper for locking a lead pushing-out mechanism is positively engaged with an engaging hole of a guide means.

Still another object of the invention is to provide an automatic pencil which can be integrally shaped by providing a resilient portion integrally interconnected to the forward end of a stopper in place of a spring for adjusting writing pressure.

The above and other objects and advantages of the present invention will be fully understood by referring to the following description setting forth preferred embodiments of the invention in connection with the accompanying drawings.

DESCRIPTION OF PREFERRED EMBODIMENTS OF THE INVENTION

Figure 1:
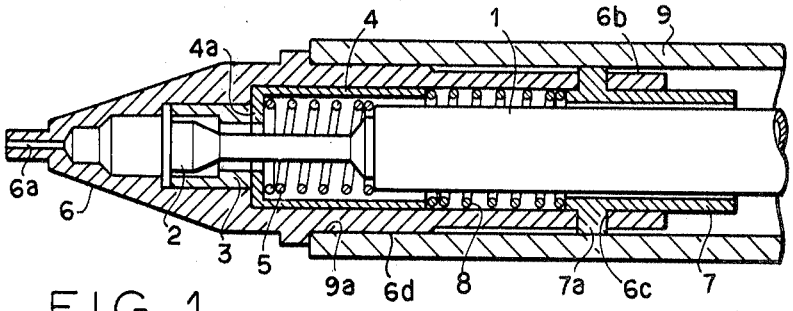
FIG. 1 is a longitudinal sectional view showing partially a first embodiment of the automatic pencil according to the present invention.
Figure 2A:
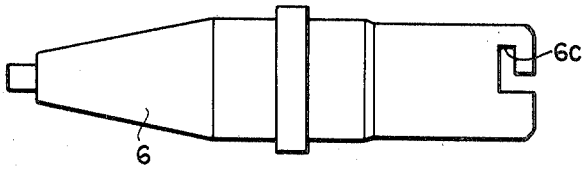
FIG. 2A is a front view showing a guide means in FIG. 1.
Figure 2B:
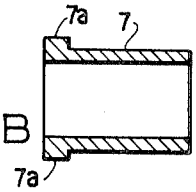
FIG. 2B is a sectional view showing a cushion stopper in FIG. 1.
Figure 2C:
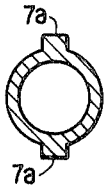

The first embodiment of the invention will now be described in connection with FIG. 1, FIGS. 2A and 2B in which there is shown a lead pushing-out mechanism comprising a lead chuck 2 fixed to the forward end of a lead container 1, a chuck ring 3 being externally fitted onto the lead chuck 2, a sleeve 4 for restricting movement of the chuck ring 3 in its axial direction, and a first spring 5 resiliently engaging with the aforesaid lead container 1, sleeve 4 and an inner collar **4*a* to retract the lead chuck 2 from its forward position to the backward position. The lead pushing-out mechanism is inserted into a pointed end cap 6 made of a synthetic resin material and having a bore 6*a* for projecting a lead at the tip of the cap. A plurality of L-shaped engaging holes 6*c* are circumferentially provided around an open edge 6*b* of the other end of the pointed end cap 6. A fixing portion 6*d* is further formed on the outer periphery of the backward portion of the cap 6**.

In addition to the above, a cushion stopper 7 on the outer periphery of which at one end thereof engaging projections **7*a*, 7*a* are formed so as to fit to the engaging holes 6*c*, respectively, is locked into the L-shaped grooves of the aforesaid engaging holes 6*c* so as to engage with a second spring 8 for adjusting writing pressure and which is resiliently mounted to the backward end of the sleeve 4. On one hand, the outer periphery fixing portion 6***d* of the pointed end cap 6 is constructed so as to mesh with an outer tube 9 in an inside screw 9*a* thereof and which is formed on the forward end of the outer tube 9 in order that the cap 6 is secured to the outer tube 9. In this case, the aligning fixation of the outer tube 9 with the bore 6*a* may be effected by means of a forcible insertion. Moreover the second spring 8 provided in the aforesaid pointed end cap 6 is also not necessarily required in view of the lead pushing-out mechanism, so that the spring 8 may be replaced by another packing and in this case, the cushion stopper 7 is utilized for locking the sleeve 4.

FIG. 3 through FIGS. 15A and 15B, inclusive, show a second embodiment of the present invention which comprises a guide means 12 into which a lead pushing-out mechanism 11 is inserted, and a stopper 13 for locking the lead pushing-out mechanism being integrally formed into a resilient portion which is fitted to the guide means 12 and urges the lead pushing-out mechanism.

The lead pushing-out mechanism 11 inserted in the guide means 12 is provided with a lead chuck 15 secured to the forward end of a lead container 14, a chuck clamping ring 16 being externally mounted on the head portion of the lead chuck 15 in a slidable manner in the axial direction, a sleeve 17 abutting upon the backward end of the chuck clamping ring 16 to restrict a movement in the axial direction thereof, and a knocking first spring (elastic member) 18 resiliently disposed between the sleeve 17 and lead container 14.

The guide means 12 being internally provided with the aforesaid lead pushing-out mechanism 11 is fitted to an end of an outer tube 19 by means of forcible insertion, thread-mounting and the like means. At least one engaging hole 20 for adjusting a position of the engagement is circumferentially provided around the inner peripheral wall of the outer tube 19.

Figures 4A, 4B, 4C, 4D, 4E, 5A, 5B, 6A, 6B:
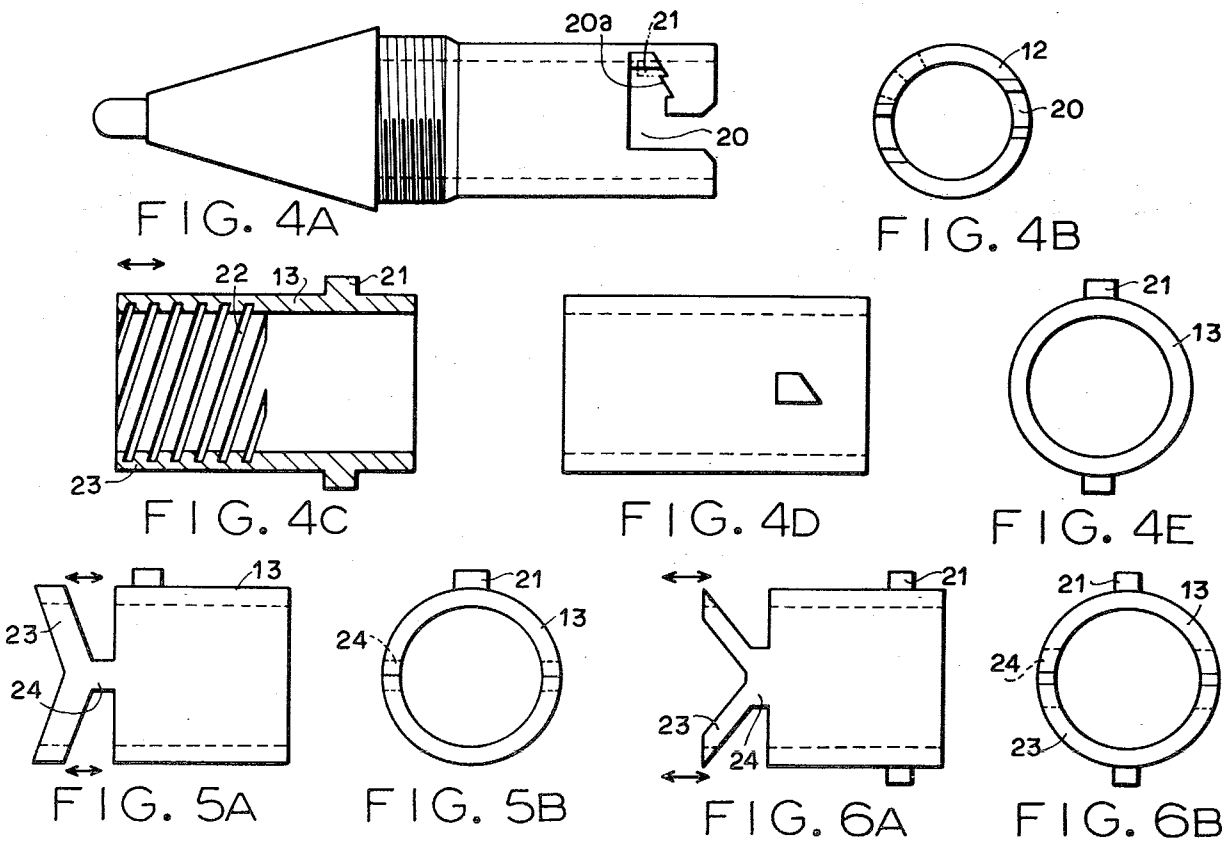
FIG. 4A is a front view showing the guide means of the automatic pencil in FIG. 1.
FIG. 4B is a side view showing the guide means of FIG. 4A.
FIG. 4C is a longitudinal sectional view showing a stopper of the automatic pencil in FIG. 1.
FIG. 4D is a front view showing the stopper of FIG. 4C.
FIG. 4E is a left side view showing the stopper of FIG. 4D.
FIGS. 5A, 6A, 7A, 8A, 9A, 10A and 11A are planar views showing other modified embodiments of the stopper of FIG. 1, respectively.
FIGS. 5B, 6B, 7B, 8B, 9B, 10B and 11B are left side views showing the stoppers of FIGS. 5A through 11A, respectively.

As illustrated in FIGS. 4A and 4B showing a front and side views of the guide means, respectively, the engaging hole 20 has a saw blade-form locking portion 20*a* with a difference in level in a part of an opposite position on the peripheral wall of the aforesaid guide means 12, so that the engaging hole is bored in substantially L-shaped groove. Thus the engaging hole 20 is formed in such that the undermentioned stopper is positively locked by means of the locking portion 20*a* and at the same time, a position to be fitted of the stopper can be adjusted.

Moreover a pair of engaging projections (engaging portions) 21 having a positively engageable shape with the locking portion 20*a* are extended on the stopper 13 for locking the aforesaid lead pushing-out mechanism and which engages with the engaging hole 20 as shown in FIGS. 4C, 4D and 4E illustrating a longitudinal sectional view, front view and side view of the stopper, respectively.

A coil-form groove 22 is bored in the inner wall of the stopper 13 from the forward end thereof to the substantially central portion thereof as illustrated in FIG. 4C, and a resilient portion 23 for adjusting writing pressure which can be extended or contracted in right and left directions as shown by the arrow is integrally provided in a line.

Then the stopper 13 is inserted from the backward end of the guide means 12 to the interior thereof to abut upon the backward end of the sleeve 17, so that the stopper 13 takes a form for energizing the sleeve 17 in a direction of the forward movement. As a consequence, the stopper 13 is locked and fitted to the guide means 12 through the engaging hole 20 and engaging portions 21 in such manner that the position of the stopper to be fitted with respect to the guide means is adjustable.

Next, the assembly and use operation of the automatic pencil according to the present invention will be described hereinbelow.

First of all, in case of assembling the automatic pencil, when the lead pushing-out mechanism 11 is inserted from the backward end of the guide means 12 to the interior thereof and rotated, the resilient portion functions, as a spring, between the sleeve 17 and stopper 13 to energize backwardly the stopper 13. As a result, the engaging hole 20 fits positively to the engaging portion 21, so that the lead pushing-out mechanism 11 and guide means 12 come to be a stationary condition with each other. Accordingly the assembly of the automatic pencil of the invention is completed by merely fitting the guide means 12 to the outer tube 19.

In this case, the engaging projections (engaging portions) 21 of the stopper 13 are backwardly energized by means of the resilient portion 23 and on one hand, the engaging hole 20 has the saw blade-form locking portion 20*a* with a difference in level. As a consequence, the fitting of the stopper 13 to the guide means 12 is very firmly effected, and there is no fear of occurring unsteadiness between the stopper and guide means.

Furthermore, since the engaging portion 21 fits to the new locking portion 20*a* with a difference in level by only rotating the stopper 13, not only the adjustment of a position of the stopper to be fitted, but also a power for adjusting writing pressure effected by energization of the sleeve 17 by means of the resilient portion 23 can very easily be varied.

As described above, according to the automatic pencil of the invention in which the resilient portion for adjusting writing pressure is integrally provided in line on the backward end of the stopper, there are such very excellent practical advantages that a spring for adjusting writing pressure is not required, that the assembly of the automatic pencil is easy and as a consequence, efficiency of the operation is remarkably elevated, further that not only the automatic pencil has a simple construction, but also a position of the stopper to be fitted in the automatic pencil as well as the adjustment of writing pressure thereof may be changed.

FIGS. 5A and 6A are planar views as well as FIGS. 5B and 6B are left side views showing the other respective embodiments of the resilient portion 23 in which the resilient portion 23 is formed into an annular shape with an inclination, and the resilient portion 23 is integrally connected to the stopper 13 by means of a connecting member 24 extending from one part of the forward end of the stopper 13.

Thus the resilient portion 23 formed into the inclined annular shape as mentioned above may sufficiently be extended or contracted in directions shown by the arrow, so that the resilient portion of the embodiments produce sufficient advantageous effects similar to those in the above stated embodiments.

Figure 7A:
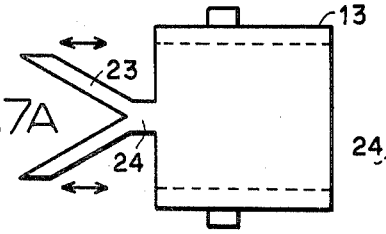
Figure 7B:
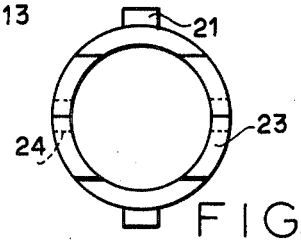

FIGS. 7A and 7B are a planar and left side views illustrating also another modified embodiment of the resilient portion 23 in which the resilient portion 23 is formed into an inclined annular-form piece, and the resilient portion 23 is integrally connected to the stopper in line by means of a connecting member 24 extending from one part of the forward end of the stopper 13.

Figure 8A:
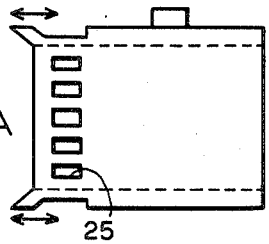
Figure 8B:
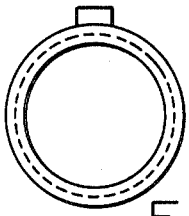

FIGS. 8A and 8B are also a planar and left side views showing another modified embodiment of the resilient portion 23 in which many perforations 25 are bored in the portion between the resilient portion 23 formed into an inclined annular form and the stopper 13, so that the resilient portion 23 can easily be extended or contracted in directions shown by the arrow.

Figure 9A:
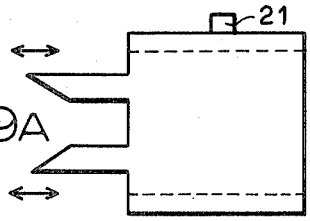
Figure 9B:
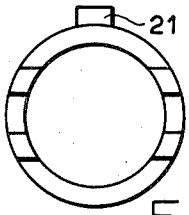
Figure 10A:
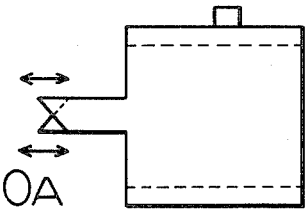
Figure 10B:
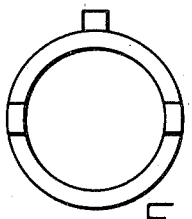

FIGS. 9A and 10A are planar views as well as FIGS. 9B and 10B are left side views showing also the other respective embodiments of the resilient portion 23 in which a plurality of rod-form resilient portions 23 are integrally provided on the forward end of the stopper 13, and each extreme end of the resilient portion 23 has an inclined plane in order that the resilient portion 23 may easily be extended or contracted in directions shown by the arrow.

Figure 11A:
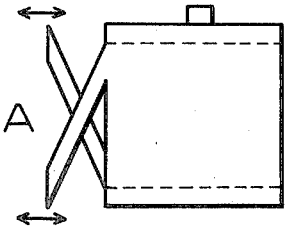
Figure 11B:
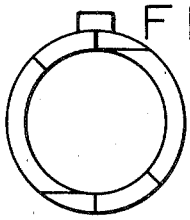

FIGS. 11A and 11B are also a planar and left side views illustrating another modified embodiment of the resilient portion 23 in which each resilient portion 23 of an annular rod piece is integrally provided on the forward end of the stopper 13 with an inclination and in also this case, the extreme end of each rod piece has an inclined plane in order that the resilient portion 23 may easily be extended or contracted in directions illustrated by the arrow.

Moreover the stopper 13 integrally interconnected with any one of the above described resilient portions 23 can also firmly be fitted to other guide means 12, for example, those illustrated in FIG. 12 through FIG. 16, respectively.

Figures 12A, 12B:
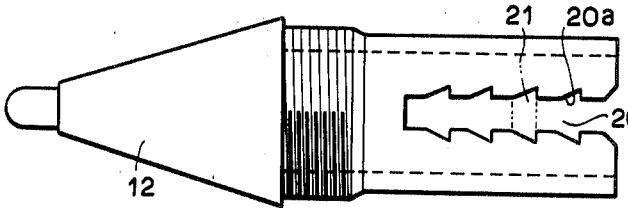
FIGS. 12A, 13A, 14A and 15A are front views showing other modified embodiments of the guide means according to the invention; respectively.
FIGS. 12B, 14B and 15B are side views showing the guide means of FIGS. 12A, 14A and 15A, respectively.

FIGS. 12A and 12B are a front and side views showing another modified embodiment of the guide means 12 in which a saw blade-form locking portion **20*a* for locking the stopper 13 is formed on the opposite sides of an engaging hole 20 extending axially from the backward end towards the forward end of the guide means 12, whilst the opposite sides of an engaging portion 21 of the stopper 13 are also formed into inclined planes. Thus the stopper 13 is very firmly engaged with the guide means 12**, and further, a position of the stopper to be fitted and the regulation for writing pressure can also be changed.

Figures 13A, 13B:
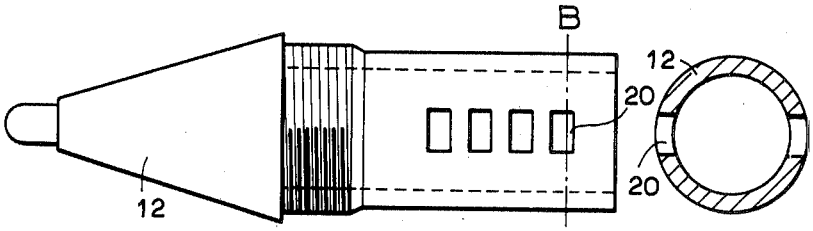
FIG. 13B is a sectional view taken along the line B—B of FIG. 13A.

FIG. 13A is a front view showing also another modified embodiment of the engaging hole 20 in the guide means portion and FIG. 13B is a sectional view taken along the line B—B of FIG. 13A in which a plurality of rectangular engaging holes 20 are bored in the guide means 12 along the axial direction with a predetermined spacing, while an engaging portion 21 of the stopper 13 which engages with the aforesaid engaging hole 20 is also formed into the corresponding shape being positively engageable with the engaging hole 20, whereby this embodiment attains similar advantages to those mentioned above.

Figures 14A, 14B:
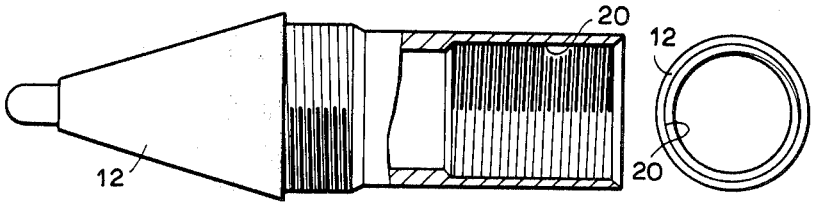

FIGS. 14A and 14B are a partly sectional view along the longitudinal direction and side view each showing also another modified embodiment of the engaging hole 20 in which an engaging hole 20 is grooved in the inner wall of the guide means 12, and the stopper 13 is forcibly inserted into the aforesaid engaging hole 20, so that this embodiment also has similar advantages to those set forth above.

Figures 15A, 15B:
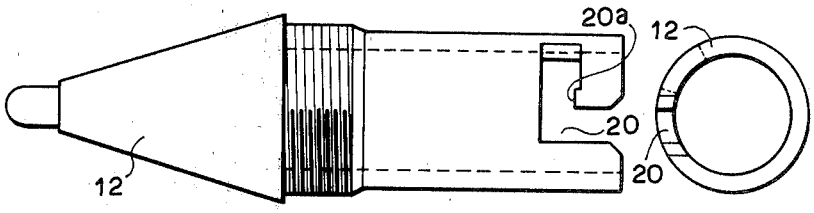

FIGS. 15A and 15B illustrate also another modified embodiment of the engaging hole 20 in which an engaging hole 20 is formed by such manner that the saw blade-form locking portion **20*a* is removed from the engaging hole 20 in the embodiment shown in FIG. 4A, but this type of engaging hole 20 cannot adjust a position of the stopper to be fitted. Another locking portion 20*a* for locking the stopper is, however, provided on this engaging hole 20 similarly to those in the above embodiments and consequently, the stopper 13 is firmly fitted to the guide means 12**, so that there is no occurrence of unsteadiness therebetween.

Figure 3:
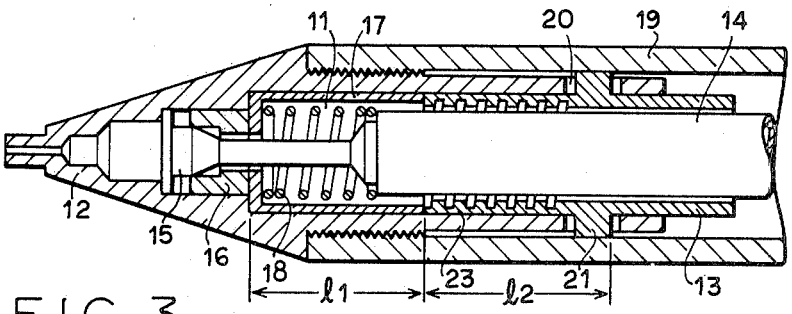
FIG. 3 is a longitudinal sectional view showing partially a second embodiment of the automatic pencil according to the present invention.

Furthermore, FIG. 3 shows a relationship of the mounted position between the aforesaid sleeve 17 and stopper 13 in which it is preferable that there is a relationship $l_1 < l_2$ between the length $l_1$ of the sleeve 17 and the length $l_2$ of from the engaging portion 21 of the stopper 13 to the backward end of the sleeve 17 in order to firmly fit the stopper 13 to the guide means 12.

In this embodiment, although the engaging portion 21 of the stopper 13 is provided in such manner that the position thereof is definitely illustrated on the stopper 13 in FIG. 3, it is to be understood that such position is not limited to this location, but any location on the stopper 13.

Moreover it is also to be noted that a plural number each of the engaging holes 20 of the guide means 12 and engaging portions 21 of the stopper 13 are not necessarily required, but one each of the engaging hole and engaging portion produce sufficiently expected advantageous effects.

In addition, though there is no restriction as to materials of the guide means 12 and stopper 13, preferable is a synthetic resin material.

FIG. 16 through FIGS. 21A, 21B, 21C and 21D, inclusive, show a third embodiment of the present invention in which the essential part of the automatic pencil comprises a guide means 32 into which a lead pushing-out mechanism 31 is inserted, and a stopper 33 for locking the lead pushing-out mechanism fitted to the guide means 32.

Figure 16:
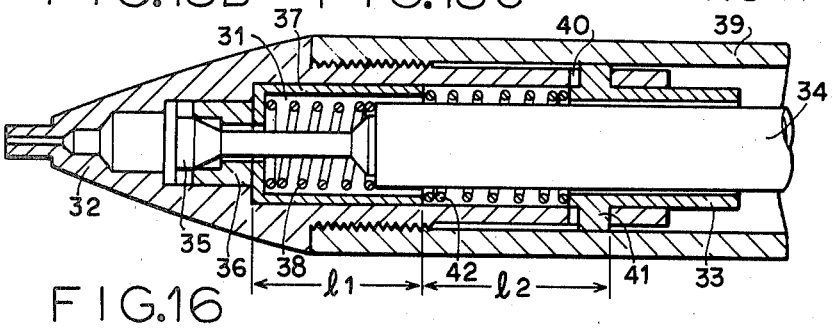
FIG. 16 is a longitudinal sectional view showing partially a third embodiment of the automatic pencil according to the present invention.

As shown in FIG. 16 being a longitudinal sectional view illustrating the guide means portion, the lead pushing-out mechanism 31 inserted into the guide means 32 is provided with a lead chuck 35 fixed to the forward end of a lead container 34, a chuck clamping ring 36 being externally fitted onto the head of the lead chuck 35 in a slidable manner in the axial direction, a sleeve 37 abutting on the backward end of the chuck clamping ring 36 and restricting the movement of the chuck clamping ring 36 in the axial direction, and a first knocking spring (elastic member) 38 resiliently disposed between the sleeve 37 and lead container 34.

The guide means 32 being internally provided with the aforesaid lead pushing-out mechanism 31 is fitted to an end of an outer tube 39 by means of forcible insertion, threadmounting and the like means. At least one engaging hole 40 for adjusting a position of the engagement is circumferentially provided around the inner peripheral wall of the guide means 32

Figure 17A:
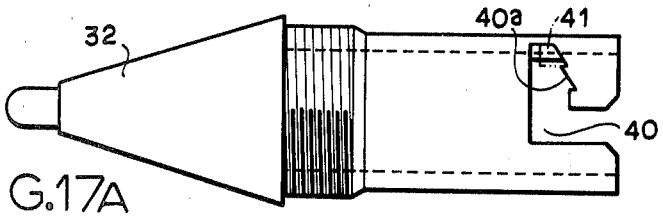
FIGS. 17A, 18A, 19A, 20A and 21A are front views showing other modified embodiments of the guide means according to the invention, respectively.
Figure 17B:
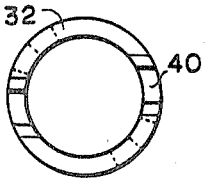
FIGS. 17B, 18B, 20B and 21B are side views showing guide means of FIGS. 17A, 18A, 20A and 21A, respectively.

As illustrated in FIGS. 17A and 17B showing a front and side views of the guide means, respectively, the engaging hole 40 has a saw blade-form locking portion **40*a* with a difference in level in a part of an opposite position on the peripheral wall of the aforesaid guide means 32, so that the engaging hole is bored in substantially L-shaped groove. Thus the engaging hole 40 is formed in such that the undermentioned stopper is positively locked by means of the locking portion 40*a*** and at the same time, a position to be fitted of the stopper can be adjusted.

Figure 17C:
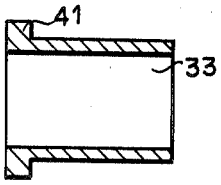
FIGS. 17C, 18C, 19C, 20C and 21C are longitudinal sectional views showing other modified embodiments of the stopper according to the invention, respectively.
Figure 17D:
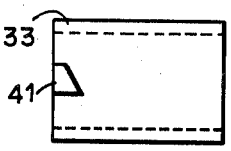
FIGS. 17D, 18D, 19D, and 21D are front views showing the stoppers of FIGS. 17C through 21C, inclusive, respectively.
Figure 18A:
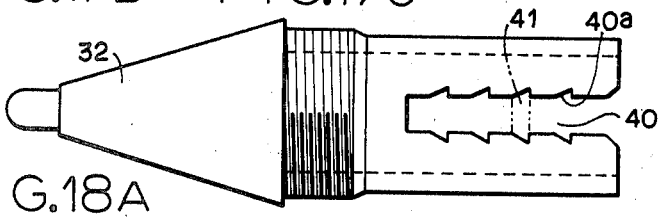
Figure 18B:
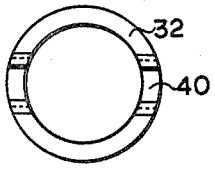
Figure 18C:
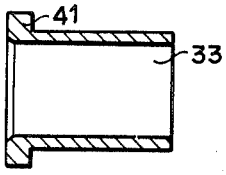
Figure 18D:
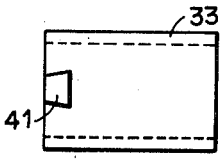

Moreover a pair of engaging projections (engaging portions) 41 having a positively engageable shape with the locking portion 40*a* are extended on the stopper 33 for locking the aforesaid lead pushing-out mechanism and which engages with the engaging hole 40 as shown in FIGS. 17C and 17D illustrating a longitudinal sectional view and front view of the stopper portion, respectively.

Then the stopper 33 is inserted from the backward end of the guide means 32 to the interior thereof and as a result, the stopper is locked and fitted to the engaging hole 40 in such manner that the position of the stopper 33 to be fitted with respect to the engaging hole 40 is adjustable through a second spring (elastic member) 42 for adjusting writing pressure and energizing the aforesaid sleeve 37 in a direction of the forward movement.

Next, the assembly and use operation of the automatic pencil according to the present invention will be described hereinbelow.

First of all, in case of assembling the automatic pencil, when the stopper 33 is inserted from the backward end of the guide means 32, into which the lead pushing-out mechanism 31 is inserted, through the second spring (elastic member) and rotated therein, the engaging hole 40 fits to the engaging portion 41, so that the guide means 32 comes to be a stationary condition with the lead pushing-out mechanism 31. Thus the assembly of the automatic pencil of the invention is completed by merely fitting the guide means 32 to the outer tube 39.

In this case, the engaging projections (engaging portions) 41 of the stopper 33 are backwardly energized by means of the second spring (elastic member) 42 and on one hand, the engaging hole 40 has the saw blade-form locking portion 40*a* with a difference in level. As a consequence, the fitting of the stopper 33 to the guide means 32 is very firmly effected, and there is no fear of occurring unsteadiness between the stopper and guide means.

Furthermore, since the engaging portion 41 fits to the new locking portion 40*a* with a difference in level by only rotating the stopper 33, not only the adjustment of a position of the stopper to be fitted, but also a power for adjusting writing pressure can very easily be changed.

As described above, the automatic pencil according to the present invention has such very excellent practical advantages that the whole parts of the automatic pencil can easily be assembled, so that efficiency of the operation is remarkably elevated, that the automatic pencil has a simple construction, and further that a position of the stopper to be fitted in the automatic pencil and the regulation of writing pressure thereof may be varied.

FIGS. 18A through 18D, inclusive, show another modified embodiment of the engaging hole 40 of the guide means 32 and the engaging portion 41 of the stopper 33 in which a saw blade-form locking portion 40*a* for locking the stopper 33 is formed on the opposite sides of an engaging hole 40 extending axially from the backward end towards the forward of the guide means 32, whilst the opposite sides of an engaging portion 41 of the stopper 33 are also formed into inclined planes. Thus the stopper 33 is very firmly engaged with the guide means 32, and further a position of the stopper to be fitted and the adjustment for writing pressure can also be changed.

Figures 19A, 19B, 19C, 19D, 20A, 20B, 20C, 21A, 21B, 21C, 21D:
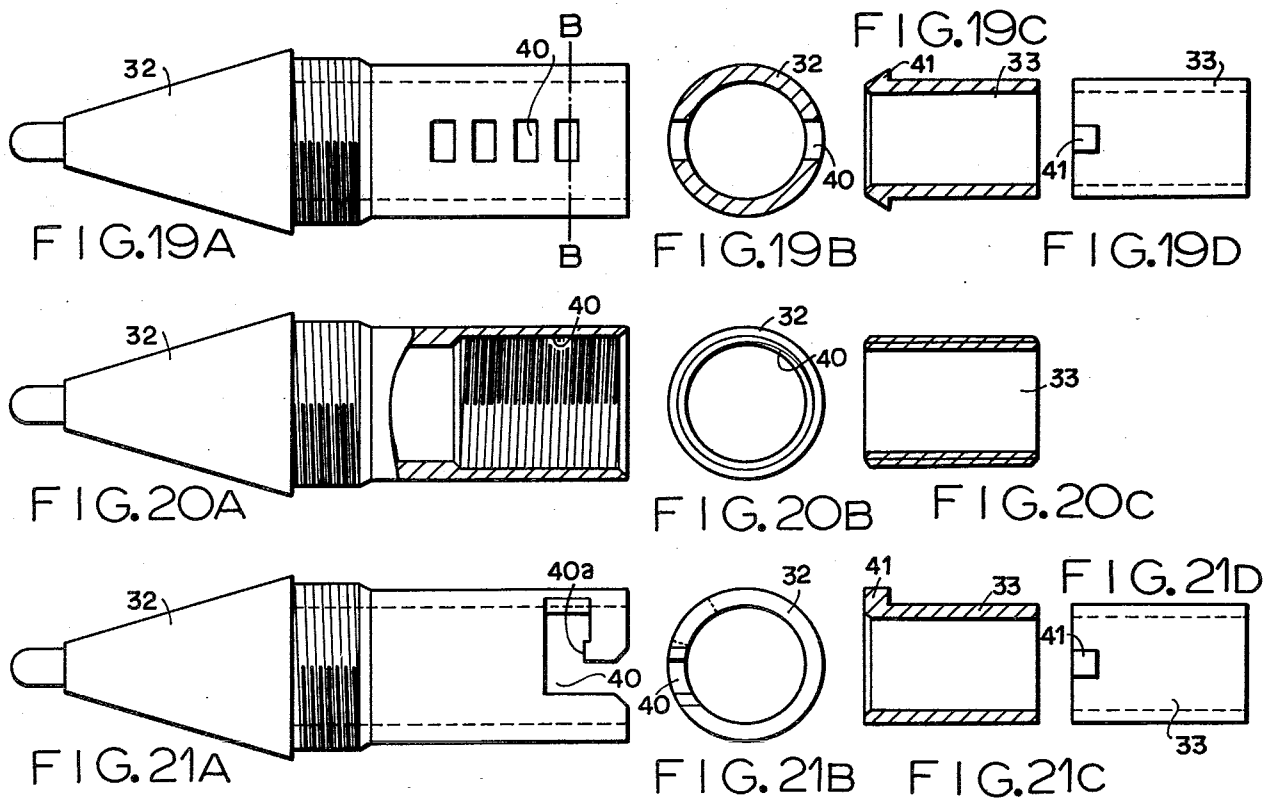
FIG. 19B is a sectional view taken along the line B—B of FIG. 19A.

FIG. 19A is a front view showing another modified embodiment of the engaging hole 40 in the guide means portion, FIG. 19B is a sectional view taken along the line B—B of FIG. 19A, FIG. 19C is a longitudinal sectional view showing the stopper and FIG. 19D is a front view showing the stopper, respectively, in which a plurality of rectangular engaging holes 40 are bored in the guide means 32 along the axial direction with a predetermined spacing, while an engaging portion 41 of the stopper 33 which engages with the aforesaid engaging hole 40 is also formed into the corresponding shape being positively engageable with the engaging hole 40, whereby this embodiment attains similar advantages to those mentioned above.

FIGS. 20A through 20C, inclusive, illustrate another modified embodiment of the engaging hole 40 and engaging portion 41 in which an engaging hole 40 is grooved in the inner wall of the guide means 32, and the stopper 33 is forcibly inserted into the aforesaid engaging hole 40, so that this embodiment also has similar advantages to those set forth above.

FIGS. 21A through 21D, inclusive, illustrate another modified embodiment of the engaging hole 40 and engaging portion 41 in which an engaging hole 40 is formed by such manner that the saw blade-form locking portion 40*a* is removed from the engaging hole 40 in the embodiment shown in FIG. 4A, but this type of engaging hole 40 cannot adjust a position of the stopper 33 to be fitted. Another locking portion 40*a* for locking the stopper 33 is, however, provided on this engaging hole 40 similarly to those in the above embodiments and consequently, the stopper 33 is firmly fitted to the guide means 32, so that there is no occurrence of unsteadiness therebetween.

Furthermore, FIG. 16 shows a relationship of the mounted position between the aforesaid sleeve 37 and stopper 33 in which it is preferable that there is a relationship $1_1 < 1_2$ between the length $1_1$ of the sleeve 37 and the length $1_2$ of from the engaging portion 41 of the stopper 33 to the backward end of the sleeve 37 in order to firmly fit the stopper 33 to the guide means 32.

In this embodiment, although the engaging portion 41 of the stopper 33 is provided on the forward end thereof, it is to be understood that such position is not limited to this location, but any location on the stopper 33.

Moreover it is also to be noted that the second spring (elastic material) 42 resiliently mounted between the guide means 32 and stopper 33 is not necessarily required in view of the lead pushing-out mechanism, but the second spring may be replaced by another packing and in this case, the stopper 33 is utilized for locking the aforesaid sleeve 37.

In addition, it is to be understood that a plural number each of the engaging holes 40 of the guide means 32 and engaging portions 41 of the stopper 33 are not necessarily required, but one each of the engaging hole and engaging portion produce sufficiently expected advantageous effects as illustrated in FIG. 21.

As mentioned hereinabove, according to the automatic pencil of the present invention, the whole lead pushing-out mechanism can be inserted into the pointed end cap, so that in assembling the parts of the automatic pencil, when the outer tube is merely secured, the automatic pencil of a knocking type can simply be manufactured. Furthermore the automatic pencil of the invention requires a small number of component parts, does not accompany any complicated working, and can be manufactured at a low price.

What is claimed is:

1. An automatic pencil comprising:
(a) an outer tube adapted to be gripped by the user;
(b) an end cap, said end cap being assembled in engagement with said outer tube by inserting the backward end of said end cap into said outer tube;
(c) a lead holding and pushing-out mechanism disposed within said outer tube, said mechanism comprising a lead container, a lead chuck secured to said container, a chuck ring externally fitted onto said lead chuck, and a spring disposed in said end cap and engaging said container;
(d) a stopper disposed within said outer tube and engaging said end cap;
(e) said end cap having a plurality of circumferentially displaced openings therein near the open end of said end cap and said stopper having projections on the outer periphery thereof engaging said openings in said end cap; and
(f) a resilient element engaging said stopper and said lead holding and pushing-out mechanism for cushioning pressure applied to the lead.

2. An automatic pencil as claimed in claim 1, wherein said resilient element comprises a spring.

3. An automatic pencil as claimed in claim 1, wherein said resilient element is formed integral with said stopper.

4. An automatic pencil as claimed in claim 1, wherein said lead holding and pushing-out mechanism further includes a sleeve engaged by said chuck ring and said resilient element engages said sleeve.

5. An automatic pencil comprising:
(a) an outer tube adapted to be gripped by the user;
(b) a guide means supported within said outer tube and in engagement therewith;
(c) a lead holding and pushing-out mechanism disposed within said guide means, said mechanism comprising a lead container, a lead chuck secured to the forward end of said lead container, a chuck ring engaging said lead chuck, a sleeve abutting said chuck ring, and a first resilient element engaging said sleeve and said lead container;
(d) said guide means including at least one hole;
(e) a stopper disposed within said guide means, said stopper including at least one engaging portion integrally formed on said stopper and engaging said hole in said guide means; and
(f) a second resilient element integrally connected to the forward end of said stopper and engaging said sleeve for cushioning writing pressure applied to the lead.

6. An automatic pencil as claimed in claim 5, wherein:
(a) said hole in said guide means includes a serrated surface providing a plurality of engaging surfaces at varying distances from the end of said guide means; and
(b) said engaging portion of said stopper is selectively engageable with any one of said plurality of surfaces for adjustably positioning said stopper to vary the writing pressure.

7. An automatic pencil as claimed in claim 5, wherein:
(a) said guide means includes a plurality of holes longitudinally spaced therealong; and
(b) said engaging portion of said stopper is a projection selectively engageable with any one of said holes for adjustably positioning said stopper to vary the writing pressure.

* * * * *